United States Patent [19]

Hanagata

[11] Patent Number: 4,693,618

[45] Date of Patent: Sep. 15, 1987

[54] DOT MATRIX PRINTER PROVIDING MULTIPLE PRINT PULSES FOR ONE ENERGIZATION OF A PRINTING HEAD STEPPING MOTOR

[75] Inventor: Takayoshi Hanagata, Yamato, Japan

[73] Assignee: Canon Kabushiki Kaisha, Tokyo, Japan

[21] Appl. No.: 844,245

[22] Filed: Mar. 24, 1986

Related U.S. Application Data

[63] Continuation of Ser. No. 630,352, Jul. 16, 1984, abandoned, which is a continuation of Ser. No. 458,330, Jan. 17, 1983, abandoned, which is a continuation of Ser. No. 225,340, Jan. 15, 1981, abandoned.

[30] Foreign Application Priority Data

Feb. 22, 1980 [JP] Japan ..... 55-20544

[51] Int. Cl.[4] ..... B41J 3/12

[52] U.S. Cl. ..... 400/120; 400/121; 400/322; 400/903

[58] Field of Search ..... 400/903, 120, 322, 121, 400/320, 279, 323, 328; 101/93.04, 93.05; 346/76 PH

[56] References Cited

U.S. PATENT DOCUMENTS

| | | | |
|---|---|---|---|
| 3,700,807 | 10/1972 | Drapeau | 178/30 |
| 3,934,695 | 1/1976 | Kovalick | 400/120 |
| 3,942,619 | 3/1976 | Nordstrom et al. | 400/903 X |
| 3,970,183 | 7/1976 | Robinson | 400/124 |
| 4,024,941 | 5/1977 | Sekikawa et al. | 400/124 |
| 4,071,130 | 1/1978 | Lichti | 400/121 |
| 4,119,383 | 10/1978 | Watanabe et al. | 400/124 |
| 4,143,980 | 3/1979 | Giebler et al. | 400/320 X |
| 4,167,342 | 9/1979 | Mower et al. | 400/124 |
| 4,169,683 | 10/1979 | Bernardis et al. | 400/124 |

*Primary Examiner*—Paul T. Sewell

*Attorney, Agent, or Firm*—Fitzpatrick, Cella, Harper & Scinto

[57] ABSTRACT

A dot matrix printer provided with a printing head having vertically aligned plural printing elements and displaced in the transversal direction of the printing sheet by a stepping motor, in which printing pulses of at least two dots are generated during a same magnetizing phase of the stepping motor and are supplied to the printing head.

2 Claims, 7 Drawing Figures

DOT MATRIX PRINTER PROVIDING MULTIPLE PRINT PULSES FOR ONE ENERGIZATION OF A PRINTING HEAD STEPPING MOTOR

This application is a continuation of application Ser. No. 630,352 filed July 16, 1984, now abandoned, which in turn is a continuation of U.S. Ser. No. 458,330, filed Jan. 17, 1983, now abandoned, which in turn is a continuation of U.S. Ser. No. 225,340, filed Jan. 15, 1981, now abandoned.

BACKGROUND OF THE INVENTION

1. Field of the Invention

The present invention relates to a dot matrix printer, and more particularly to a dot matrix printer in which the displacement of the printing head is performed by a stepping motor.

2. Description of the Prior Art

In the wire dot printers and thermal printers there are often employed printing heads having printing elements vertically aligned in a line.

FIG. 1 shows the structure of a conventional thermal printer having such vertically aligned heating elements, wherein a thermal head 1 is fixed on a carriage 3 slidably mounted on a horizontal slide member 2 and is positioned to be in contact with a platen 6 across a printing sheet 5 supplied from a paper roll 4.

Said carriage 3 is fixed by a mounting member 3*a* to an endless belt 9 provided between pulleys 7 and 8. Said pulley 8 is coaxially fixed to a pulley 10 of a larger diameter which is linked by a belt 14 to a pulley 13 fixed on an output shaft 12 of a DC motor 11. On said shaft 12 and under said pulley 13 there is fixed a slit disk 15 having radial slits 16 at determined angular intervals. Across said slit disk 15 there is provided a photocoupler 17 for detecting the rotational position of said output shaft 12.

FIG. 2 is a timing chart which indicates the heat pulses to be given to the thermal head 1 as the printing instrution signals are generated in synchronization with the output signals of said photocoupler 17.

The printer explained above is adequate for continuous carriage displacement in a line but is not suitable for intermittent carriage displacement because of the characteristic of DC motor. For this reason a stepping motor has been employed as the driving source for enabling both continuous and intermittent printing, and, in such case, the slit disk 15 and the photocoupler 17 can be dispensed with.

FIG. 3 shows the relationship between the excited phases of stepping motor, carriage movement and heat pulses wherein the carriage is displaced repeating vibration of a same pattern in response to each control pulse. Consequently the heat pulses can be generated in synchronization with the pulses supplied to the stepping motor.

The recent progress in the thermal head technology has enabled printing with pulses of a duration of 0.5 ms and an interval of 1 ms, which are ten times faster than the priority considered limits of pulse duration of 5 ms and pulse interval of 10 ms. In order to comply with such high printing speed, the stepping motor has to be driven with pulses of an interval of 1 ms or at a rate of 1000 pps. As the stepping motor provides a smaller output torque at a higher speed, there is therefore required an expensive stepping motor with an elevated power consumption for providing a higher torque and a higher frequency response.

SUMMARY OF THE INVENTION

The object of the present invention is to provide a dot matrix printer allowing a high-speed printing with a relatively inexpensive stepping motor and still maintaining the performance that has only been achievable with an expensive stepping motor.

The aforementioned object is achieved according to the present invention in a dot matrix printer in which the lateral printing position in dot matrices is determined in synchronization with the pulses for various excited phases of the stepping motor, said printer being featured in that print pulses for at least two dots are generated within a same excited phase of the stepping motor.

DESCRIPTION OF THE PREFERRED EMBODIMENTS

Now the present invention will be clarified in detail by the preferred embodiments thereof shown in the attached drawings.

Figure 1:
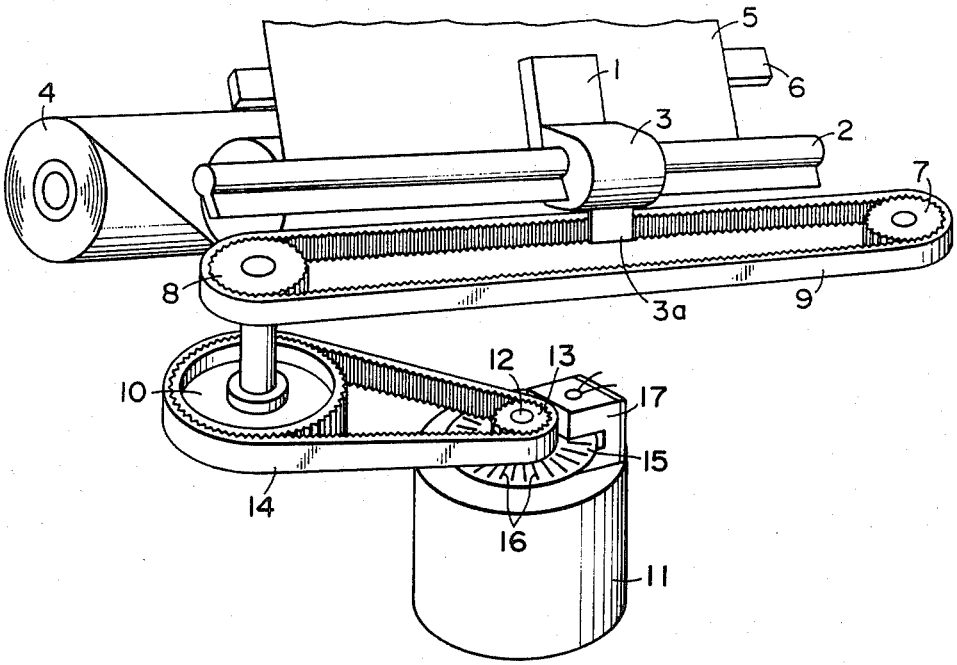
FIG. 1 PRIOR ART
FIG. 1 is a perspective view showing a conventional thermal printer driven with a DC motor.
Figure 2:
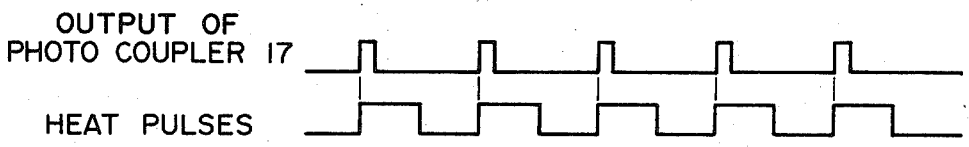
FIG. 2 PRIOR ART
FIG. 2 is a timing chart showing the relation between the photocoupler output signals and heat pulses in the printer shown in FIG. 1.
Figure 4:
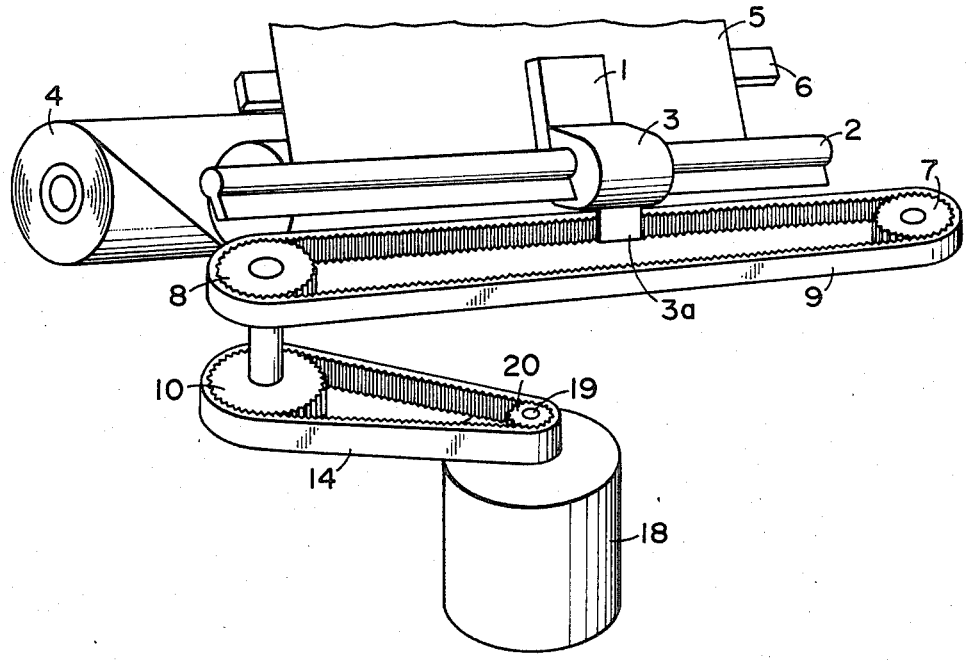
FIG. 4 is a perspective view of an embodiment of the present invention.

FIG. 4 shows an embodiment of the present invention, wherein the same components as in FIG. 1 are represented by the same numbers and are omitted from the following description.

In the present embodiment there is employed an ordinary stepping motor 18 of no particular precision as the drive source, and a pulley 20 fixed on an output shaft 19 thereof is linked by a belt 14 with a pulley 10 for achieving a speed reduction ratio is $\frac{1}{2}$ by the pulleys 8, 10 and 20.

Figure 5:
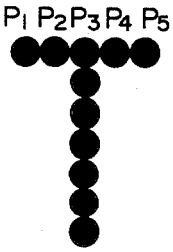
FIG. 5 is a plan view of a character printed by the printer embodying the present invention.

FIG. 5 shows, as an example, a character "T" printed by $5\times7$ dot matrix, in which the positions of vertical seven dots are determined by the heating elements of the thermal head while those of horizontal five dots are determined by the carriage displacement.

Figure 7:
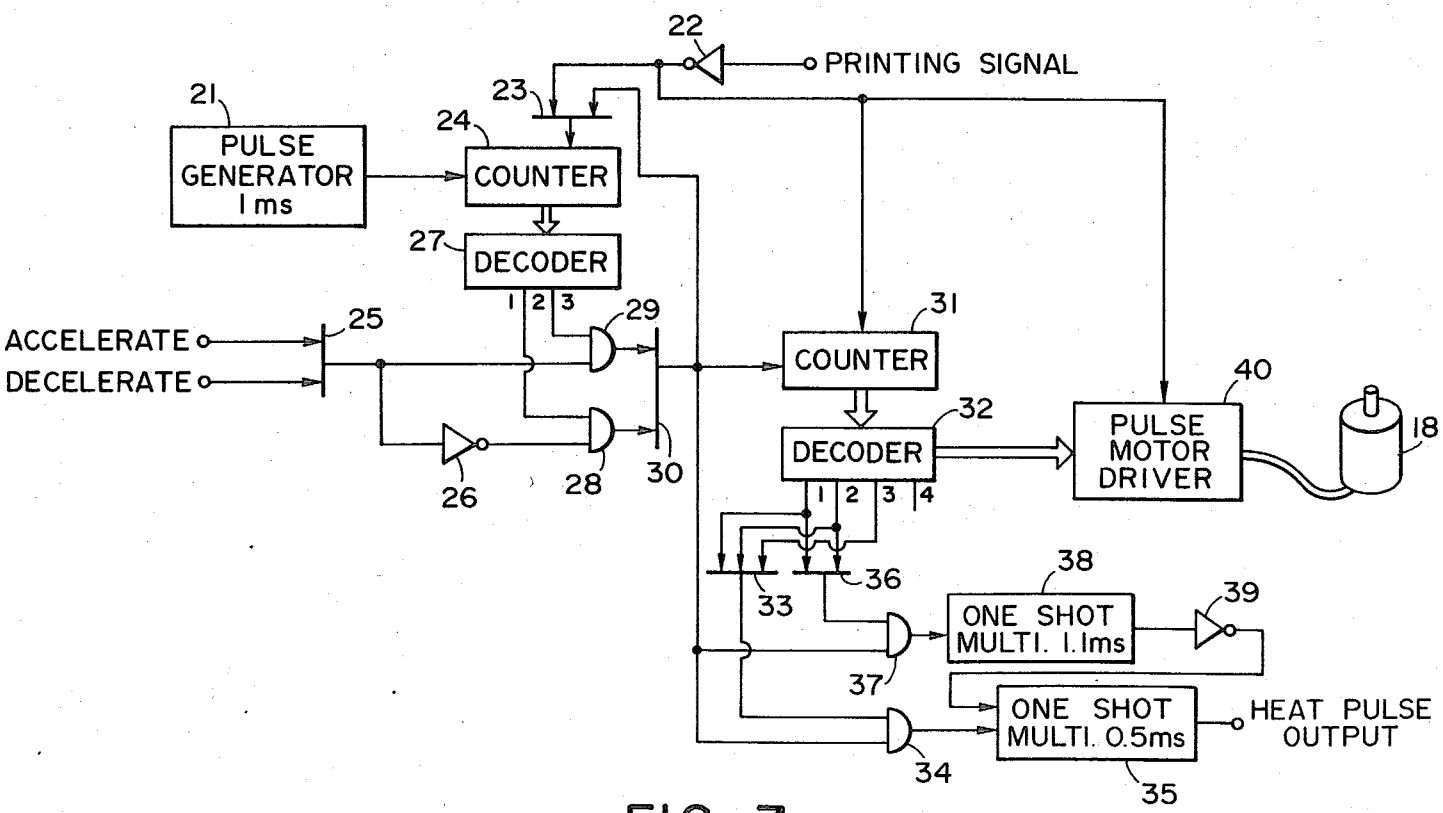
FIG. 7 is a circuit diagram for generating control pulses and heat pulses.

FIG. 7 is a timing chart showing the relation between the excited phases of stepping motor 18, pulse duration, carriage movement and heat pulses.

Figure 6:
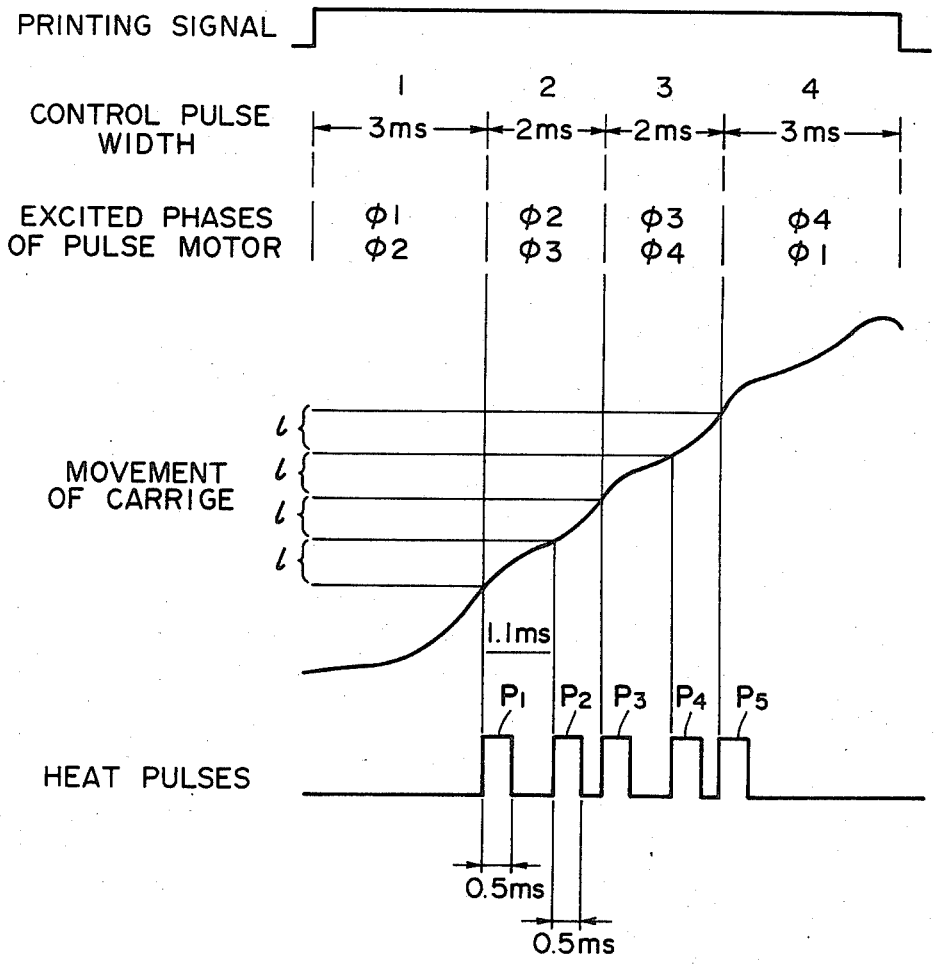
FIG. 6 is a timing chart showing the control method for the printer embodying the present invention.

In the present embodiment the pulse signals supplied to the stepping motor 18 have varying durations. As shown in FIG. 6, the first control pulse has a duration of 3 ms, while the second and third control pulses have a duration of 2 ms, and the fourth control pulse again has a duration of 3 ms. Such varying durations of four control pulses are one of the features of the present invention.

Figure 3:
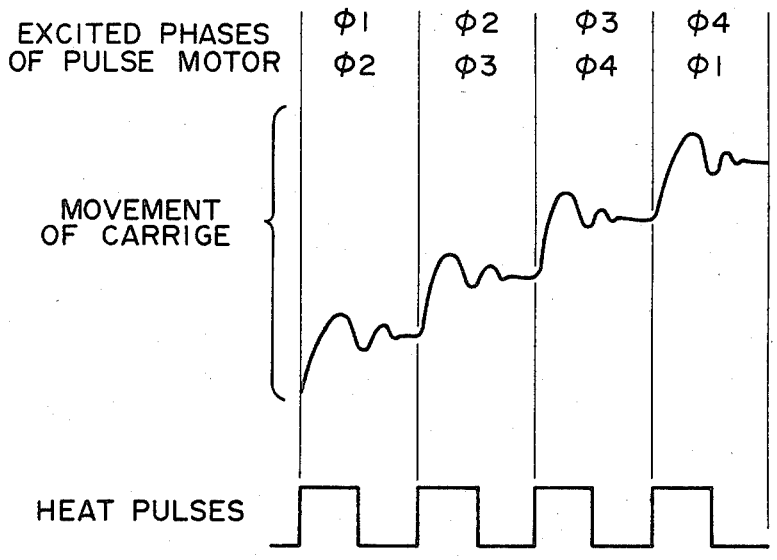
FIG. 3 PRIOR ART
FIG. 3 is a timing chart showing a control method of a conventional thermal printer driven with a stepping motor.

This is due to the fact that at least a longer pulse is required for acceleration before reaching a constant speed in order to achieve high-speed drive against elevated inertia of the rotor of stepping motor 18 and of the carriage 3. The second and third control pulses of a duration of 2 ms achieve quasi-linear continuous carriage displacement with reduced vibration in comparision with the carriage movement in the conventional structure shown in FIG. 3, because the pulses of shorter duration cause the carriage displacement to the succeeding position before the vibration can be generated. The fourth control pulse is again made longer to 3 ms for decelerating the carriage 3 in high-speed movement.

Heat pulses P1, P3 and P5 are generated respectively in synchronization with the second, third and fourth control pulses to the stepping motor, and there are additionally generated heat pulses P2 and P4 respectively between the heat pulses P1 and P3, and between the heat pulses P3 and P5.

The heat pulse corresponding to the first control pulse to the stepping motor for making a space between the neighboring characters is absent. The heat pulses P2 and P4 generated between the second and third control pulses supplied to the stepping motor at intervals of 2 ms are not positioned at the exact center between the heat pulses P1 and P3 or P3 and P5 but are somewhat displaced therefrom. As is obvious from the curve shown in FIG. 6, the displacement of the carriage is almost linear but is still fluctuates so that the timings of heat pulses P2, P4 are displaced according to the calculations made from said curve wherby the lateral five dots are equally spaced by distance l as shown in FIG. 6 to achieve dot matrix printing of an extremely high quality in which the dots in the horizontal direction are completely uniformly spaced.

As an example, in the present invention, the pulses P2 and P4 are generated at 1.1 ms from the second control pulse, i.e. 0.1 ms behind the center at 1 ms between second and third control pulses spaced by 2 ms so as to obtain uniform distribution of th dots in the horizontal direction according to the moving curve of the carriage. In this manner there is obtained a satisfactory print quality as shown in FIG. 5.

As will also be seen from FIG. 6, the heat pulses P1, P3 and P5 generated in synchronization with the control pulses to the stepping motor and the intermediate heat pulses P2 and P4 are both generated and supplied to the thermal head 1 during the displacement of the carriage so that the printed dots are formed in principle by the synthesis of the moving trajectory of the carriage and the position of heating elements, but they in fact appear in visually circular shape because of the pulse duration as short as 0.5 ms.

FIG. 7 shows a circuit for generating control pulses to the stepping motor 18 and heat pulses required in the present invention.

In FIG. 7, a pulse generator 21 constantly generates pulse signals at an interval of 1 ms. However, when the print signal is at L-level, an OR gate 23 receives an H-level signal through an inverter 22 to reset a counter 24 for counting the pulses from said pulse generator 21 to retain the content of said counter at zero.

When the print signal is shifted to H-level, the inverter 22 releases an L-level signal whereby the counter 24 initiates the counting of pulses from the pulse generator 21. At the same time, in response to the shifting of output from the inverter 22 from H-level to L-level, a stepping motor driver 40 releases the first control pulse. At this point the acceleration signal is at H-level to release an H-level signal from an OR gate 25, so that an inverter 26 releases an L-level signal.

In this state a decoder 27 releases an output "2" but an AND gate 28 is closed. Subsequently the decoder 27 releases an output "3", and an AND gate 29 is opened by the H-level signal from said OR gate 25 to release an H-level signal from an OR gate 30. In this manner said output signal is obtained from the OR gate 30, 3 ms after the shift of print signal to H-level and is stored as "1" in another counter 31 whereby the first control pulse is terminated. Also the counter 24 is reset by an H-level signal received at the reset terminal thereof from the OR gate 23 and again initiates pulse counting from zero. Besides the counter 31 is reset by the output from the inverter 22.

At the application of the second control pulse to the stepping motor 18, because of absence of acceleration signal or deceleration signal, the OR gate 25 releases no output signal to maintain the output of the inverter 26 at H-level, whereby the output "2" from the decoder 27 is transmitted through the AND gate 28 and the OR gate 30. Thus, said output is released after 2 ms in this case. In this state the counter 31, having a content "1", causes a decoder 32 to emit an output "1" to an OR gate 33, whereby an AND gate 34 releases an H-level output to activate a one-shot multivibrator 35 thereby supplying a heat pulse P1 of a duration of 0.5 ms to the thermal head 1.

At the same time the output "1" from the decoder is transmitted through an OR gate 36 to open an AND gate 37 whereby another one-shot multivibrator 38 is also activated to generate a pulse signal of a duration of 1.1 ms, which is supplied through an inverter 39 to another input terminal of the aforementioned one-shot multivibrator 35, thus again generating another heat pulse of a duration of 0.5 ms after the laspe of 1.1 ms. The latter corresponds to the intermediate heat pulse P2 shown in FIG. 6.

The heat pules P3, P4 are similarly generated when the content of said counter 31 is equal to "2".

When the content of the counter 31 is equal to "3", the OR gate 30 releases the output after 3 ms because of the deceleration signal supplied to the circuit in the same manner as in the intitial acceleration. In this state the OR gate 33 is open but the OR gate 36 remains closed so that the one-shot multivibrator 35 is activated but not 38.

In this manner five heat pulses are generated within a determined period, among which the first, third and fifth are released in synchronization with the excited phases of the stepping motor 18, while the second and fourth are generated somewhat displaced from the center of the control pulses of 2 ms duration.

In FIG. 7, 40 indicates a drive circuit for the stepping motor 18. The displacing time of said intermediate pulses P2, P4 is determined by the time constant of said one-shot multivibrator 38.

As explained in the foregoing the present embodiment allows printing with doubled speed of the motor capacity even with a motor of a relatively limited precision, since there are generated two heat pulses during a single control pulse supplied to the stepping motor, one of said heat pulses being synchronized with said control pulse while the other being generated in the duration of said control pulse and at such timing as to obtain uniform dot distribution in the horizontal direction in consideration of the displacing characteristic of the carriage.

It is furthermore possible to generate three heat pulses for one control pulse to the stepping motor by adding another one-shot multivibrator similar to 38 for determining the pulse timing.

Although the present invention has been explained by an embodiment of printer having a thermal head for 5×7 dot matrix printing, it will be apparent that the present invention is also applicable to any other dot matrix printer provided with a printing head having vertically aligned plural printing elements, such as a wire dot matrix printer.

As detailedly explained in the foregoing, the present invention, features generating at least two print pulses during the duration of a pulse signal for controlling the stepping motor, i.e. during a same excited phase of the stepping motor for supply to the dot matrix printing head, and further features generating one of said pulses in response to the displacing characteristic of the carriage, to provide a dot matrix printer which is inexpensive in cost and still capable of high-speed printing with satisfactory print quality achieved by uniform dot distribution in the horizontal direction.

What I claim is:

1. A dot matrix printer with a stepping motor for relatively moving a printing head and a printing sheet, comprising:

a printing head having at least one printing element for printing on the printing sheet in response to print pulses;

a stepping motor for relatively moving said printing head and the printing sheet once during each excited phase of said stepping motor;

motor drive signal generating means for generating a motor drive pulse;

motor drive means operable in response to the motor drive pulse for exciting each phase of said stepping motor to drive said stepping motor;

timer means having a set time perioid, said timer means being operable in response to the motor drive pulse for generating an additional pulse preceding the next motor drive pulse at the set time period; and head drive means for generating print pulses in response to both the motor drive pulse and the additional pulse, wherein the set time period of said timer means is selected so that the distance between dots produced in response to the print pulses is uniform.

2. A dot matrix printer according to claim 1, wherein the additional pulse generated by said timer means is interpolated into a position lagging behind the center position between one motor drive pulse and the next motor drive pulse.

* * * * *

UNITED STATES PATENT AND TRADEMARK OFFICE

CERTIFICATE OF CORRECTION

PATENT NO. : 4,693,618

DATED : September 15, 1987

INVENTOR(S) : TAKAYOSHI HANAGATA

It is certified that error appears in the above-identified patent and that said Letters Patent is hereby corrected as shown below:

IN THE DRAWINGS

On the cover sheet, "CARRIGE" should read --CARRIAGE--.
Sheet 2, Fig. 3, "CARRIGE" should read --CARRIAGE--.
Sheet 3, Fig. 6, "CARRIGE" should read --CARRIAGE--.

COLUMN 1

Line 42, "instrution" should read --instruction--.
Line 62, "priority" should read --prior--.

COLUMN 2

Line 51, "is" should read --of--.
Line 58, ""FIG. 7" should read --FIG. 6--.

COLUMN 3

Line 29, "is" should read --it--.
Line 31, "wherby" should read --whereby--.
Line 36, "invention" should read --embodiment--.
Line 40, "th" should read --the--.

COLUMN 4

Line 40, "pules" should read --pulses--.

UNITED STATES PATENT AND TRADEMARK OFFICE

CERTIFICATE OF CORRECTION

PATENT NO. : 4,693,618

DATED : September 15, 1987

INVENTOR(S) : TAKAYOSHI HANAGATA

It is certified that error appears in the above-identified patent and that said Letters Patent is hereby corrected as shown below:

COLUMN 5

Line 15, "invention," should read --invention--

Signed and Sealed this

Twenty-second Day of March, 1988

*Attest:*

DONALD J. QUIGG

*Attesting Officer*

*Commissioner of Patents and Trademarks*